United States Patent [19]

Jansson et al.

[11] 4,227,430

[45] Oct. 14, 1980

[54] HAND TOOL

[75] Inventors: Conny Jansson; Ulf Wahlberg, both of Enköping, Sweden

[73] Assignee: AB Bahco Verktyg, Enköping, Sweden

[21] Appl. No.: 45,192

[22] Filed: Jun. 4, 1979

[30] Foreign Application Priority Data

Jun. 30, 1978 [SE] Sweden ..... 7807425

[51] Int. Cl.[3] ..... B25G 1/08

[52] U.S. Cl. ..... 81/177 M; 145/62; 16/110.5

[58] Field of Search ..... 81/177 M, 177 N; 145/61 J, 62, 50 C; 16/110.5; 206/372, 376–378

[56] References Cited

U.S. PATENT DOCUMENTS

| | | | |
|---|---|---|---|
| 2,337,514 | 12/1943 | Wilcox | 145/62 |
| 3,667,518 | 6/1972 | Stillwagon | 145/62 |
| 3,683,984 | 8/1972 | Hull | 81/177 M X |

FOREIGN PATENT DOCUMENTS

| | | | |
|---|---|---|---|
| 396874 | 8/1933 | Australia | 145/62 |
| 138190 | 8/1950 | Australia | 145/62 |

*Primary Examiner*—James G. Smith

*Attorney, Agent, or Firm*—Oldham, Oldham, Hudak & Weber

[57] ABSTRACT

A rotatable hand tool, especially a screwdriver or other rotating tool for screws or nuts. The tool is of the kind having cavities in its handle for storing at least one, or usually several tool bits, which can optionally be attached to a holder attached to and turned by the holder. Such bits can, for example, constitute screwdriver tips, hexagonal socket keys and hexagonal sockets. The handle consists of two main parts, of which one is rotatably enclosed in the other and has cavities arranged in the form of recesses in its periphery, these recesses being accessible by turning the enclosed part so that one of its recesses coincides with an opening in the other part. A limited axial movement between both handle parts and between coacting locking means thereon enables these parts to turn respective to each other in an outer axial position, and is locking them against rotation in an inner axial position of the enclosed part.

2 Claims, 5 Drawing Figures

HAND TOOL

The invention relates to a rotatable hand tool, especially a screw-driver, with a handle having a holder for a tool bit at one end. The bits primarily intended here are bits for slotted-head, cross-slotted head or socket head screws and sockets for small hexagonal head screws. The handle is further formed with cavities for storing at least one, and preferably several bits fitting the holder.

Such handles are already known, e.g. from the U.S. Pat. Nos. 648,589 and 2,337,514. The tool in the prior art has a handle with a plurality of openings at their free end, which are optionally accessible by turning a cover or plate. The bits are taken out in the axial direction of the handle when one of the cavities therein has been exposed. With these solutions for exposing the handle cavities, one is entirely dependent on marking the handle as an aid to selecting the right adaptor, since there is only a negligible view into the cavity via its opening. The older of the two patents mentioned also provides an example of a customary deficiency with known handles, namely that the end of the handle does not offer an acceptacle grip on the handle when tightening up a screw, since the end is not unrotatably attached to the rest of the handle.

The object of the invention is to provide an improved tool of the kind discussed in the introduction. The improvement primarily sought for here is an exposure of one handle cavity at a time such that substantially the hole of the bit in the cavity is exposed and can thus be easily identified. In other words, what is striven for is a solution facilitating the selection of the right bit. It is also essential that when the tool is used, the handle is functionally equal to a handle made in one piece and that its cavities are not unintentionally opened.

The desired result is obtained by the tool being given the characterizing features apparent from patent claim 1.

An embodiment of a tool in accordance with the invention will now be described in detail in the following while referring to the accompanying drawings.

Figure 1:
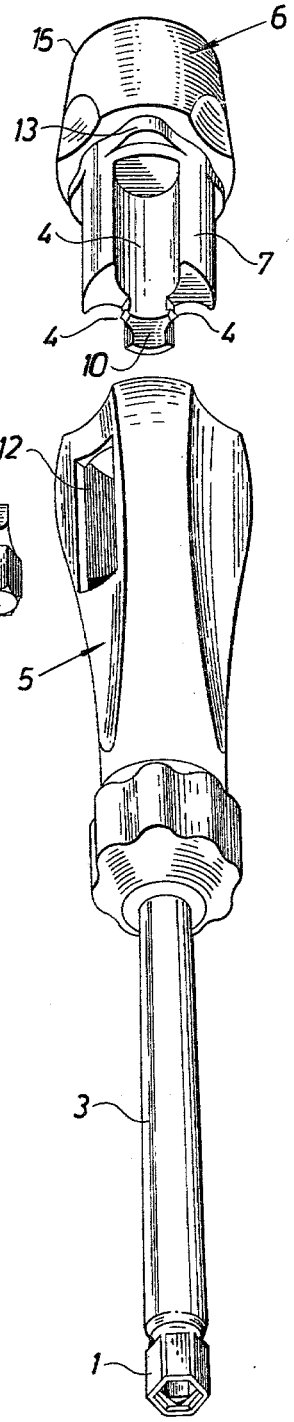
FIG. 1 is an exploded view of the tool, with a rotor and a tubular portion forming the handle illustrated separately. Some bits are also illustrated.
Figure 2:
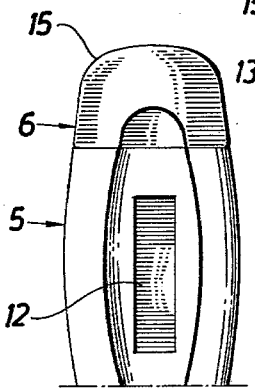
FIG. 2 is a partial side view of the tool handle in an assembled condition and disposed for using the tool.

The tool illustrated on the drawings is a screwdriver with a handle having a blade 3 pressed into an attaching hole in the handle, at the free end of the blade there being a holder 1 for a bit 2.

The handle is formed with three cavities 4 for accommodating and storing the bits 2, illustrated in the form of two bits for slotted-head screws and one for a cross-slotted-head screw. At their rear ends these bits are formed as hexagonal studs, all with the same across flats dimension and fitting the hexagonal opening in the holder 1, which is also provided with a spring catch.

Figure 4:
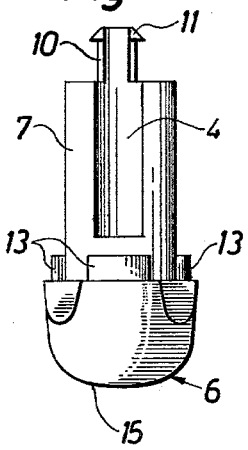
FIG. 4 is a side view of the rotor.
Figure 5:
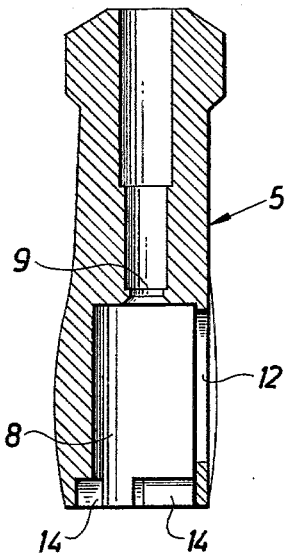
FIG. 5 is a longitudinal section through the tubular portion.

The handle consists of a tubular part 5, also forming the end of the handle carrying the holder 1, and a rotor 6 accommodated in the tubular part 5, said rotor simultaneously forming the opposing free end of the handle, and in FIGS. 1 and 4 is shown separated from the tubular part 5.

The handle cavities 4 are disposed about the rotor 6, and consist of recesses in the rotor periphery, open outward in a radial direction. As is apparent from FIG. 1, they extend as grooves, U-shaped in cross section, along a rotor portion 7, the basic shape of which has a circular cross section with a diameter allowing turning the rotor by hand when the rotor is placed in the cylindrical central hole 8 of the tubular part 5. The hole 8 accommodates the rotor portion 7.

Between the cylindrical central hole 8 and the attachment hole for the blade there is a wall portion with a hole 9, having a smaller diameter than the attachment hole and through which a central journal 10 on the rotor 6 is introduced when the rotor is fitted into the tubular part. The journal 10 has outwardly directed end flanges 11, which snap in behind said wall portion when they have passed through the hole 9. The rotor will thus be locked to the tubular part. However, the journal 10 has a length such that it permits the rotor a restricted axial movement.

The tubular handle part 5 has in its wall an opening 12 in towards the rotor 6. The opening 12 is sufficiently large to allow the passage of an adaptor 2 out of, and into the respective recess 4, when a recess is put opposite the opening 12 by turning the rotor.

Figure 3:
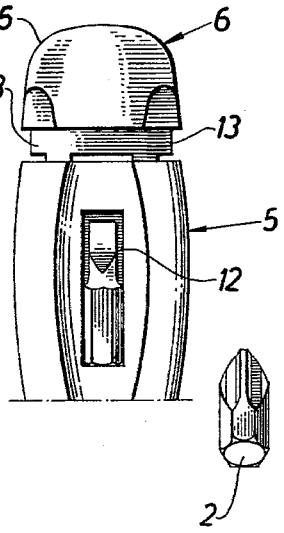
FIG. 3 is a view corresponding to that in FIG. 2, but with the handle adjusted for removing a bit from one of the cavities.

The axial movement allowed by the journal 10 to the rotor 6 is utilized to prevent unintentional rotation of the rotor. Projections 13 on the rotor portion 7 are so situated that when the rotor 6 is pressed into its deepest position in the tubular part 5 they engage in recesses 14 in the mouth portion of the hole 8. The engagement between the three projections 13 and the three recesses 14 makes the rotor 6 non-rotatable in the tubular part 5, in one of the three positions of turn each of which localize the opening 12 to a portion of the rotor portion 7 which does not have any of the recesses 4. The cavities in the handle formed by the recesses are thus closed off. To release the rotor 6 for turning in the tubular part 5, it is necessary to pull the rotor axially outwards sufficiently far for the projection 13 to come outside the tubular part 5 (FIG. 3), which is precisely the restricted axial movement allowed by the length of the journal 10.

The free end 15 of the handle in the illustrated embodiment if formed by a terminating portion on the rotor 6 which, in form and dimension, merges into the adjacent end of the tubular part 5. The handle end 15 is thus effectively prevented from turning while using the tool, when the rotor is pressed into its deepest position in the tubular part.

Within the scope of the invention, it is also possible to allow the tubular part to form the free end of the handle and arrange the bit holder on the rotor.

The rotor and the tubular part can to advantage be produced in a customary manner from plastics, while the holder and associated blade are suitably manufactured from steel of a quite conventional kind.

We claim:

1. A rotatable hand tool, especially a screwdriver, with a handle having a holder (1) for a tool bit (2) at one end and formed with handle cavities (4) for storing at least one such bit (2) which fits the holder (1), characterized in that the handle consists of an outer tubular part (5) also forming one end of the handle, and a rotor (6) accommodated in the tubular part (5), said rotor simultaneously forming the opposing free end of the handle, the cavities (4) being disposed about the rotor (6) and consisting of radial recesses in the periphery thereof, while the tubular part has an opening (12) which, by mutual rotation between the rotor (6) and the tubular part (5) can be localized radially outside an optional recess (4) in the rotor, thereby allowing removal and replacement of a bit from and into the rotor, said rotor (6) being movably connected to the tubular part (5) with limited axial movement, their being coacting locking means (13, 14) on the rotor and in the tubular part disposed such that when rotor and tubular part are pressed axially towards each other, the rotor and tubular part are non-rotatably locked to each other, and when rotor and tubular part are moved slightly in the opposite axial direction said locking means allow the rotor to rotate in relation to the tubular part for adjusting the opening (12) therein the relation to the recesses (4) in the rotor.

2. A tool as claimed in claim 1, characterized in that the rotor (6) forms the free end (15) of the handle, while the tubular part (5) forms the opposite end of the handle, forming the end carrying the holder (1).

* * * * *